United States Patent [19]

Bare et al.

[11] Patent Number: 5,054,480

[45] Date of Patent: Oct. 8, 1991

[54] PERSONAL AIR FILTRATION AND CONTROL SYSTEM

[75] Inventors: Rex O. Bare; David R. Millar, both of Irvine; Harry N. Herbert, Fullerton, all of Calif.

[73] Assignee: Bio Medical Devices, Inc., Fullerton, Calif.

[21] Appl. No.: 537,700

[22] Filed: Jun. 14, 1990

[51] Int. Cl.[5] ..... A62B 7/00

[52] U.S. Cl. ..... 128/201.25; 128/201.29; 128/205.25; 128/206.12; 128/206.21; 128/206.28; 128/207.11

[58] Field of Search ..... 128/205.25, 206.12, 128/206.16, 206.17, 206.21, 206.23, 206.24, 206.28, 207.11, 201.25, 201.29

[56] References Cited

U.S. PATENT DOCUMENTS

| | | | |
|---|---|---|---|
| 911,389 | 2/1909 | Garforth | 128/202.19 |
| 2,341,566 | 2/1949 | Monroe | 128/207.11 X |
| 2,353,643 | 7/1949 | Bulbulian | 128/207.11 |
| 3,130,722 | 4/1964 | Dempsey et al. | 128/206.28 |
| 3,525,334 | 8/1970 | Braman et al. | 128/201.25 |
| 3,529,595 | 9/1970 | Weeden | 128/202.19 |
| 3,649,964 | 3/1972 | Schoelz | 128/205.25 |
| 3,688,314 | 9/1972 | Hill | 128/201.24 X |
| 3,955,570 | 5/1976 | Hutter, III | 128/201.23 |
| 3,963,021 | 6/1976 | Bancroft | 128/201.25 |
| 4,011,865 | 3/1977 | Morishita | 128/205.25 X |
| 4,019,508 | 4/1977 | DerEstaphanian et al. | 128/202.19 |
| 4,055,173 | 10/1977 | Knab | 128/201.29 X |
| 4,136,688 | 1/1979 | Gorman | 128/206.24 X |
| 4,227,520 | 10/1980 | Lord | 128/201.24 |
| 4,280,491 | 7/1981 | Berg et al. | 128/201.24 |
| 4,331,141 | 5/1982 | Pokhis | 128/205.25 X |
| 4,336,799 | 6/1982 | Almasi et al. | 128/201.24 |
| 4,462,399 | 7/1989 | Braun | 128/201.25 |
| 4,549,542 | 10/1985 | Chien | 128/205.25 |
| 4,577,348 | 3/1986 | Hoffmann | 128/206.23 X |
| 4,677,976 | 7/1987 | Fujinuma et al. | 128/206.17 X |
| 4,730,612 | 3/1988 | Dampney | 128/201.24 |
| 4,771,771 | 9/1988 | Walther | 128/206.17 X |
| 4,848,366 | 7/1989 | Aita et al. | 128/206.24 X |
| 4,901,716 | 2/1990 | Stackhouse et al. | 128/201.25 |
| 4,965,887 | 10/1990 | Paoluccio et al. | 2/9 |

FOREIGN PATENT DOCUMENTS

| | | | |
|---|---|---|---|
| 8809193 | 12/1988 | World Int. Prop. O. | 128/207.11 |

*Primary Examiner*—Edgar S. Burr
*Assistant Examiner*—Eric P. Raciti
*Attorney, Agent, or Firm*—G. Donald Weber, Jr.

[57] ABSTRACT

An air flow and filtration control system in the form of a headgear which is worn by a physician during a surgical procedure, a technician during an assembly process, or any other user wherein a controlled air flow and air filtration is required or desired. The flow through system includes a relatively rigid, open frame, skeleton headgear structure which substantially surrounds the head of the wearer. The structure includes ductwork and is adjustably attached to a headband formed of straps which are adapted to snugly engage the head of the wearer.

A plurality of fans or other air moving devices are mounted in the structure. The fans are positioned to move air through the integral ducts in the structure. A shroud (or hood) is draped over and attached to the structure in such a fashion as to completely cover the structure and to cover at least a portion of the wearer in order to maintain sterile or controlled conditions. A relatively planar transparent screen or "window" is provided at the front of the apparatus for substantially undistorted viewing. Typically, the transparent screen is mounted in the shroud and is removable therewith. FIltration devices are formed or mounted in the shroud so as to be disposed adjacent to the fans when the shroud is placed over the structure. A suitable power supply, such as a battery pack or the like, is used to selectively power the fans. It is anticipated that at least the shroud (and the components mounted thereto) will be disposable.

23 Claims, 2 Drawing Sheets

PERSONAL AIR FILTRATION AND CONTROL SYSTEM

BACKGROUND

1. Field of the Invention

This invention is directed to air flow and filtration systems, in general, and to a headgear which is worn by an individual to control and filter air flow during a procedure wherein control of filtered air is required, in particular.

2. Prior Art

There are several types of air flow and/or filtration systems which are known in the art. More particularly, there are several types of such systems which are currently available on the market for use in surgical or "clean room" situations.

However, some of the existing systems have a bulbous or hemispherical, transparent viewing screen which creates substantial distortion for the wearer. In the case of surgical procedures, especially very delicate surgical procedures, any type of visual distortion is undesirable. The distortion can, in some instances, create a situation with moderate to important safety problems. On the other hand, this distortion can create substantial fatigue in the surgeon because of the additional intensity required to compensate for the distortion during the surgical procedures.

Similarly, in "clean room" situations, such distortion can be a problem in terms of fatigue, inaccurate operations and the like. This can result in the fabrication of defective products or the like.

In addition, the systems which are known in the art include an air movement system which takes the form of hoses, tubes or the like which are attached to, or connected with, other supply sources such as air bottles or the like. This arrangement tends to be cumbersome and/or restrictive in terms of movement by the wearer.

Furthermore, the systems known in the art tend to produce an uneven airflow therethrough. This has the effect of creating drafts in some locations and little or no airflow in other locations within the system. This can, sometimes, result in the transparent shield becoming fogged due to condensation of expired air and the like generated by the surgeon or technician during the procedures involved.

Also, in some systems the transparent shield is separated from the protective hood. This arrangement permits air to flow around the shield. However, it also permits contamination to pass around the shield, as well. Thus, contaminated air or substances can come into contact with the wearer. Conversely, the wearer can provide contaminated air, or the like, to the work space.

Some of the existing systems include hoods, gowns, filters and the like. In some instances, the filters are built into the helmet structure and produce a rather clumsy, cumbersome headgear unit. Other units include external sources which are connected to the control unit by tubes, hoses or the like. Of course, the hose-connected fluid sources tend to become cumbersome and limiting in the movements and flexibility of the wearer during a procedure.

PRIOR ART STATEMENT

A formal patentability search has not been conducted. However, the best known prior art is listed herewith. Other prior art systems may exist and this list is not warranted to be total and/or complete.

STACKHOUSE: Surgical Helmet Systems (Freedom TM).

INTERSAFE INTERNATIONAL B.V.: Clean-room airhood (MICROSAFE TM).

DE PUY: Surgical Exhaust System (Sterile View TM).

SUMMARY OF THE INSTANT INVENTION

A protective system which is worn by a surgeon during a surgical procedure, a technician during an assembly process, a worker during handling of toxic wastes, or the like. The system includes a substantially rigid headgear skeleton or open-frame structure which is attached to an adjustable headband similar to that used for welding helmets and the like. The headband includes straps for specifically adjusting the size thereof to the wearer. A plurality of fans or other air movement devices are mounted in the headgear structure.

The system also includes a relatively limp or flaccid fabric-like shroud which is adapted to be attached to or draped over the structure to completely cover the structure and, as well, to cover a portion of the wearer in order to maintain sterile, non-contaminating conditions. A relatively planar transparent screen is provided in the shroud. Typically, the screen is curved in one plane and is arranged to be disposed at the front of the headgear for relatively undistorted viewing by the wearer. A plurality of filter devices is mounted in the shroud and arranged to be disposed adjacent to the fans in the headgear. A suitable power supply, such as a battery pack or the like, is used to selectively power the fans.

DESCRIPTION OF A PREFERRED EMBODIMENT

Figure 2:
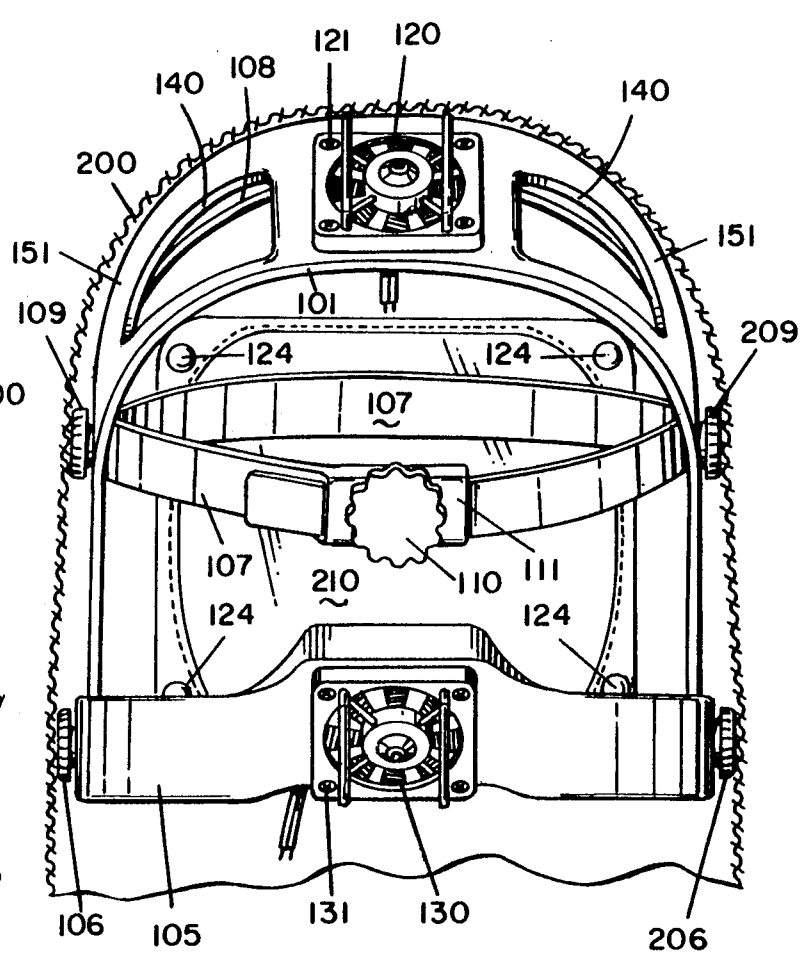
FIG. 2 is a rear view of the embodiment of the instant invention shown in FIG. 1.
Figure 1:
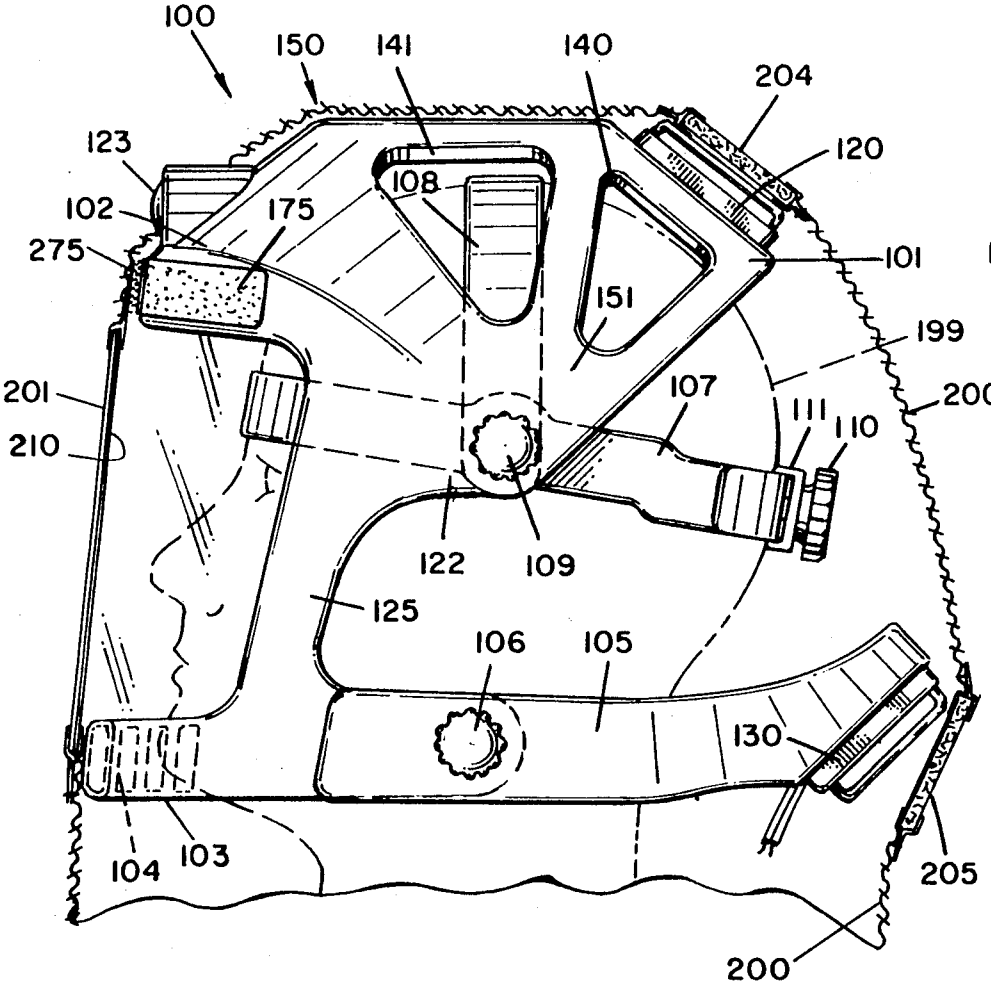
FIG. 1 is a side or a plan view of one embodiment of the structure of the instant invention.

Reference is made to FIGS. 1 and 2, concurrently. FIG. 1 is a side or plan view of one embodiment of the instant invention, while FIG. 2 is a rear view thereof. In FIG. 1, the head 199 of a wearer is shown in dashed outline to provide an environment or application for the invention.

The system includes a basic, relatively rigid headgear structure 100 which is selectively covered by a relatively limp shroud 200 (shown in cross-section in FIG. 1). The structure includes an upper portion 150 which is adapted to be placed over the head of the wearer. The upper (or cranial) portion 150 is configured to substantially follow the generally oval contours of a human head. As will be described, the cranial portion 150 is arranged to be spaced away from the wearer's head.

In particular, the back edge 101 of the upper portion 150 of the headgear structure 100 is adapted to be spaced above and, generally, behind the head of the wearer. In like fashion, the front portion 102 of the upper portion 150 of the headgear structure 100 is designed to be spaced above and forwardly relative to the wearer thereof.

Similarly, the front portion 102 extends beyond the face of the wearer so that the shroud 200 (or hood) depends from structure 100 but is spaced away from the wearer's face. In addition, a suitable connection mechanism 175, such as a tacky adhesive strip, a hook-and-loop material (such as sold under the Trademark VELCRO), or the like, is placed on the surface of the upper front portion 102. This mechanism operates to retain shroud 200 in the preferred orientation and to prevent inadvertent movement thereof. A complementary connection mechanism 275 is, typically, provided on the inner surface of the shroud 200 to mate with connection mechanism 175.

In FIG. 1, the upper portion 150 of the headgear structure 100 is shown to be relatively angulated. However, it should be understood that the upper surface 150 can be smoothly rounded or modified as seen fit. Moreover, the front and back edges 102 and 101, respectively, may be repositioned and/or located differently relative to the structure 100, as desired. Of course, the entire structure 100 should be relatively lightweight and properly balanced so as to reduce tension and fatigue when worn during use. That is, many functions related to the use of the headgear are long and tedious. Therefore, the headgear system should be as unobtrusive as possible.

The upper section of the headgear 100 including cranial portion 150, back edge 101 and front edge 102 are also joined to the side sections 151 of the headgear structure 100. The side sections 151 include a central mounting portion 122 which is arranged to be placed at approximately the temporal position of the wearer's head. The mounting (or temporal) portion 122 is adapted to provide a pivotal mounting location for an internal support liner, as described hereinafter.

The upper portion 150 and the side section 151 of the structure 100 also include openings 140 and 141 therewith. While these openings are shown to be substantially triangular in configuration, any shape or size aperture is deemed appropriate. That is, the major purpose of the openings 140 and 141 is to reduce the amount of material used in the headgear 100 in order to reduce the cost and the weight thereof.

The lower front portion 103 is joined to the upper (or cranial) portion 150 by a suitable strut 125. The front portion 103 is curved to form a support bar adjacent to the front bottom of the wearer's head in the region of the jaw. The lower front portion 103 is adapted to be spaced away from the wearer's face. In addition, the front portion 103 operates to maintain the shroud 200 spaced away from the wearer's face A plurality of openings 104 may be provided in the jaw member 103 to permit improved vocal communication from the wearer of the structure to other members of the surgical staff or other team.

The upper (or cranial) portion 150 of the headgear 100 including front portion 102, back portion 101, side section 151, temporal portion 122 and lower front portion 103 are, in a preferred embodiment, integrally formed of a high strength, high impact plastic material such as ABS polycarbonate, or the like.

A rear support arm 105 is also provided and substantially encircles the neck area of the wearer. Again, the rear support arm !05 serves to define the position of the shroud 200 relative to the wearer when the shroud 200 is placed on the headgear structure 100. In addition, the support arm 105 is used to mount the exhaust fan 130. Fan 130 is arranged to move air out of or away from the headgear structure.

The rear support arm 105 can be pivotally mounted to the rear part of the lower front portion 103. In the pivotally mounted embodiment shown in FIGS. 1 and 2, the support arm 105 and lower front portion 103 are joined together by a suitable connector such as a knob 106 (and/or 206). Typically, the knob 106 (and/or 206) is adjustable so as to permit the support arm 105 to move relative to the lower front portion and, thus, the cranial portion 150. That is, the support arm 105 is mounted to pivot or rotate around the junction point defined by the knob 106 so that comfortable positioning vis-a-vis the wearer is achieved. When a preferred position is selected, knob 106 (and/or 206) is tightened so as to prevent further movement of arm 105 until knob 106 is loosened.

In addition, an internal support mechanism or headband liner is provided. This liner mechanism is similar to such liners as found in other helmets or headgear and includes an adjustable head-gripping multi-strap unit. In particular, an upper strap 108 is arranged to pass over and rest upon the top of the head of the wearer. Similarly, a lateral strap 107 encircles the head of the wearer. In this embodiment, the ends of the vertical strap 108 are joined to approximately the midpoints of the lateral strap 107.

The joint between straps 107 and 108 is mounted to the mounting or temporal portion 122 of the headgear structure 100. In particular, this mounting is a pivotal mounting which is secured by a knob 109 (and/or 209). In order to position the headgear structure 100 relative to the liner straps (and the wearer's head), knob 109 (and/or 209) is loosened. When the headgear structure 100 is positioned properly, the knob 109 (and/or 209) is tightened whereupon the structure 100 is substantially fixed in position relative to the liner straps.

The front portion of strap 107 is continuous and is adapted to rest upon and engage the forehead of the wearer. The rear portion of strap 107 comprises a pair of loose ends which are arranged to be engaged by a suitable clamp 111. In essence, one loose end of strap 107 passes through a connecting portion of clamp 111 which is formed on the other loose end of strap 107. A knob 110 (or other clamping device) is adapted to be rotated to, thus, grip the loose end of strap 107 which passes through the clamp portion 111. By adjusting the loose ends of strap 107 in the clamp 111, the strap 107 can be arranged to snugly engage the wearer's head. Because of the relative dimensions, the straps 107 and 108 snugly engage the wearer's head but maintain the headgear structure 100 in spaced (and selectively movable) relation to the wearer's head. Thus, the structure 100 and the shroud 200 supported thereby do not rest directly on the wearer's head. This arrangement permits air flow and circulation around the wearer's head, as described infra.

Figure 3:
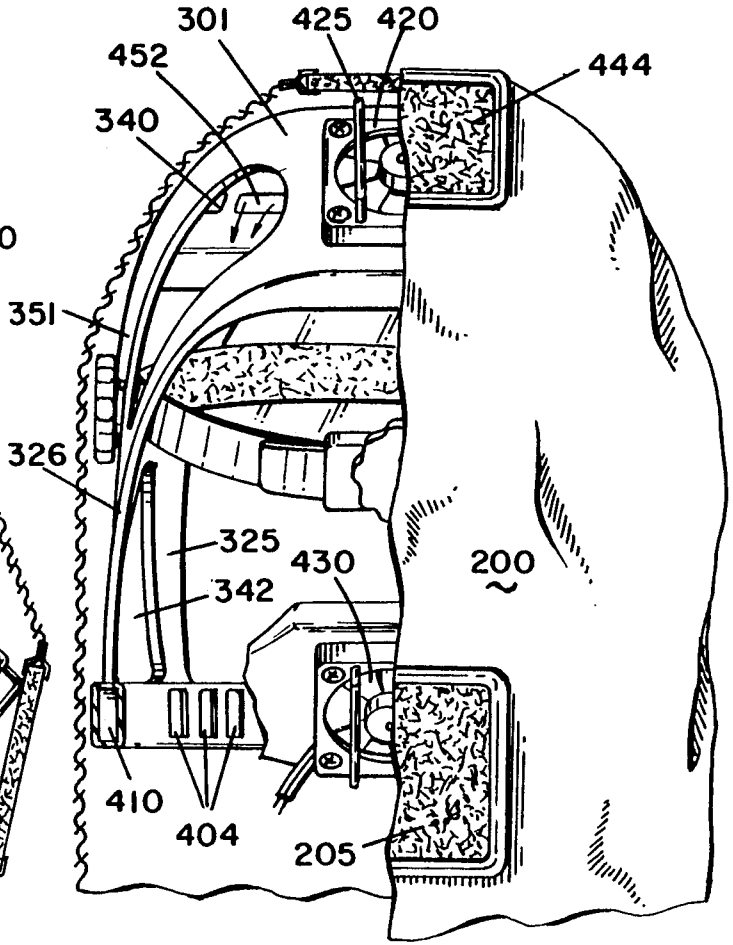
FIG. 3 is a rear view of another embodiment of the structure of the instant invention with a shroud shown partially broken away.
Figure 4:
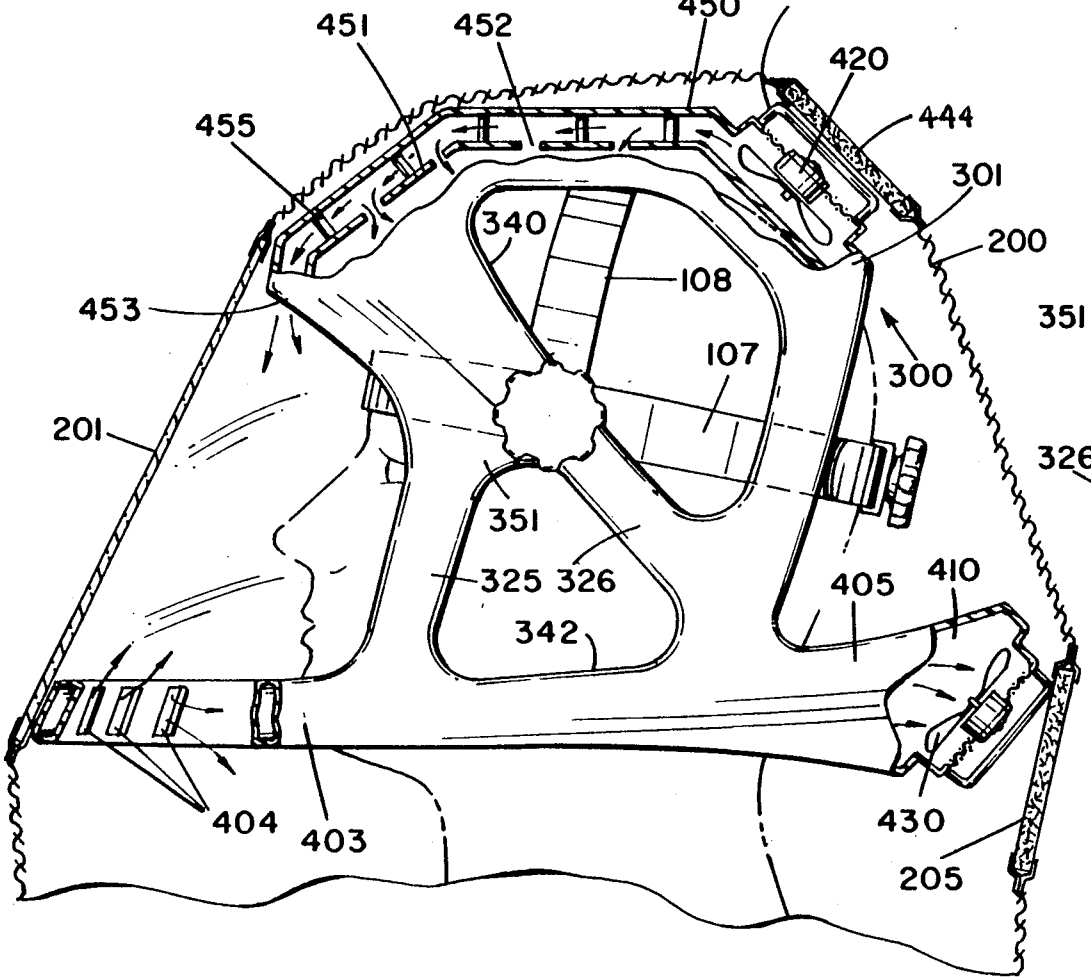
FIG. 4 is a side or plan view of the embodiment of the structure of the instant invention shown in FIG. 3 with a shroud shown partially broken away.

In addition, one or more high efficiency fans or blowers 120 can be mounted in the upper portion 150 of the helmet by suitable fasteners 121. Likewise, one or more fans 130 are mounted at the rear portion of the rear support arm 105 by suitable fasterers 131. Fan 130 can be a low efficiency fan, if so desired. Typically, the fans 120 and 130 are relatively small, flat fans which are mounted at the rearward portions of the headgear structure. Air flow is generated from the back of the headgear by fan 120 and is arranged to pass forwardly across the top of the wearer's head and down across the face of the wearer. The air is also drawn out of the headgear structure by means of fan 130 which is, in effect, an exhaust fan. In general, the air flow is between the head 199 of the wearer and the inside surface of the headgear structure 100. The cooperation of the intake fan 120 and the exhaust fan 130 permits air flow across the face of the wearer thereby to minimize perspiration or the like. In addition, the air flow inhibits and/or minimizes the possibility of condensation on the inner surface of the transparent shield 201. This air flow is facilitated by the space between the wearer's head and the inner surface of upper portion 150 of the headgear structure 100. Of course, the upper portion 150 can be a hollow duct-like unit which communicates with fan 120 and through which air flows. As shown in FIGS. 3 and 4, a ductwork structure can be formed in the upper portion of the headgear so as to direct the airflow around the wearer's head.

The shroud 200 is, typically, a relatively thin, flaccid sheet of cloth or the like. Of course, multiple layers of material such as melt blown polypropylene, polyolefins or the like, can be used, if desired. The shroud 200 is, preferably, arranged as a pre-formed hood which is selectively placed over the headgear structure 100 and selectively (and removably) adhered thereto by means of the connector mechanisms 175 and 275.

The shroud 200 is made to fit reasonably snugly to the headgear structure 100 so as to remain in the preferred position and orientation. Typically, the shroud 200 extends over the shoulders of the wearer so as to provide a reasonably secure sphere of influence relative to the wearer's head. This arrangement contains the air flow and filtration control system as well as providing a containment device for limiting contamination to or by the wearer.

As noted, the flexible shroud 200 can be affixed to the headgear structure 100 by means of appropriate snaps, hook-and-loop fasteners, or the like. The cover can be cloth, paper or other relatively limp, flaccid material which drapes in free-form from the headgear 100. In typical fashion, the shroud is draped over the upper portion 150 and down beyond the rear portion 101 of the headgear 100 to completely envelop the head and shoulders of the wearer. Typically, the shroud extends past the lower surface of the jaw member 103 and the rear support arm 105 and is about 36 inches wide and 30 inches long. Of course, these dimensions are not limitative of the invention.

A substantially planar, transparent shield 201 is included in an opening in shroud 200 and mounted in front of the headgear 100. The shield 201 is mounted to the shroud 200 by means of stitching, tape or suitable fasteners 124. Typically, the shield 201 is fabricated of a thin, optically clear, lightweight sheet of plastic such as PETG film (which can be stamped, molded or the like) as well as radiation sterilized without discoloring. The shield can be sewn, taped, or otherwise secured in the shroud 200. In any event, the transparent shield 201 is curved only slightly around the face of the wearer so that peripheral vision is permitted. However, the curvilinear surface is curved in only one plane, preferably without any compound curvature, and adapted to produce very little visual distortion to the wearer.

In one embodiment, the shield 201 may include a thin layer 210 or coating of hydrogen or other anti-fogging material to prevent fogging of the shield.

The shroud 200 also includes a filtering means. For example, the shroud material may be of a composition which operates as a filter, per se. Typically, however, a plurality of filter devices are mounted directly into the shroud 200, for example by sewing, taping, gluing or the like. Alternatively, the shroud 200 can incorporate a plurality of pockets into which filters can be selectively and replaceably mounted. For example, the filters 204 are arranged to interact with fans 120 and filters 205 are arranged to interact with fans 130, respectively. Thus, fan 120 draws air into the system through filter 204. Thus, the wearer receives clean, filtered air input.

Conversely, fan 130 exhausts air from the system through filter 205. Thus, filtered air is exhausted into the ambient. Also, air pressure within the system remains balanced. This can be especially important in surgical applications of the invention.

In the preferred embodiment, the shroud 200 and the filters (uniform or discrete) are intended to be disposable. This arrangement has a distinct advantage over prior art systems with built-in, permanent filters. That is, any contaminants, bacteria or the like which are trapped in the filter are discarded with the disposable filter. The possibility of contamination in permanent (or reusable) filters known in the art is readily apparent and is overcome by this invention. Moreover, the filters are preferably able to filter to 0.1 micron. In addition, the filters can be found of multiple layers of filter material including a layer of carbon which can filter odors as well as other particulate-like materials.

A suitable battery pack or other power source (not shown) is connected to the headgear 100 by any suitable fashion so as to provide the appropriate power to the fans and yet be unobtrusive and out-of-the-way for the wearer of the headgear. Typically, the power supply can be mounted to the other garments of the wearer in any convenient fashion and is connected to the electrical components by means of a wire or cable 125.

In addition, a suitable light source 123, including fiber optics for example, can be formed in or mounted to the headgear structure 100. In particular, the light source 123 can be mounted at or near the top front portion 102 so as to project a beam of light directly in front of the apparatus thereby to bathe a field of view in a focused light. It is also contemplated that light source 123 can produce a focused ultraviolet (UV) light beam which would serve to inhibit bacterial infection. In this case, the transparent shield 210 might require UV light correction and/or protection.

Referring now to FIGS. 3 and 4, there is shown an alternative embodiment of the instant invention. In this embodiment, similar components bear similar reference numerals.

The basic structure of this embodiment, as in the other embodiments, includes a rigid, skeleton headgear structure 300 and a covering hood or shroud 200. The structure 300, as before, can be molded, stamped, vacuum formed, or fabricated in any suitable and appropriate fashion. The hood 200 (shroud) can be formed of fabric, non-woven fabric, polypropylene or similar materials, as noted. The shroud includes a transparent, planar viewing shield 201. The mounting liner straps 107 and 108 are pivotally mounted to the structure 300 as in the embodiment shown and described relative to FIGS. 1 and 2.

In this embodiment, the upper part 350 of the structure 300 is somewhat more elongated than the upper portion 150. In addition, the support struts 325 and the temporal portion 351 have rather different shapes or conformations. Also, another support strut 326 is added between the temporal portion 351 and the rear arm 405. As a result, the openings 340 is of somewhat different configuration then opening 140 and an opening 342 is provided. Nevertheless, the structure 300 functions in substantially the way as the structure 100 version described supra. Similarly, the fan 420 (or fans) are mounted in the upper back portion 301 of the headgear 300. This arrangement moves the air intake away from any smoke or other fumes that may be produced during electrosurgical procedures or the like. In addition, the location of the fans helps in weight distribution of the helmet.

As shown in FIG. 4, the upper portion 450 comprises a hollow duct-like channel which communicates with fan 420. Thus, the fan draws air in through filter 444 in shroud 200. Properly positioned standoffs 425 extend slightly beyond the fan 420 so a to prevent the shroud from becoming entangled or caught in the fan and also maximizes the "effective" area of the filter.

The duct-like upper portion has outer an inner surfaces. The outer surface is continuous. However, the inner surface 451 includes one or more perforations 452 therethrough. Thus, the air flow can be directed onto the head of the wearer. A slot 453 formed between the inner and outer surfaces, spaced near the forehead of the wearer directs air flow across the face of the wearer and the inside of the window.

In addition, a number of spacers 455 are inserted between the inner and outer surfaces. The spacers are fabricated of a soft, foam-like material and serve to maintain the surfaces in spaced apart relation and, as well, to prevent vibration thereof. This latter aspect tends to reduce the noise generated by the fan 420 and the air flow through the headgear structure by minimizing resonance.

In this embodiment however, the lower rear arm 405 is integrally connected to or formed with the lower front arm 403. In addition, this combined unit is substantially continuous and encircles the head or neck portion of the wearer. A fan 430 (or fans) is mounted, preferably, at the rear of the structure. In addition, the collar (arms 403 and 405) is formed or fabricated as a hollow tube-like member. The interior channel 4 to passes through the entire length of the hollow member. The channel ultimately communicates with the fan 430 so that any air within the channel is exhausted out of the back of the unit as before. In particular, the exhausted air is passed through filter 205.

In addition, one or more apertures 404 are formed through the inner surface of the arm 403. These apertures communicate with the channel 410. Thus, the air expelled by the wearer is preferentially received into channel 410 through apertures 404 and, therefore, exhausted through fan 430 preventing $CO_2$ and heat accumulations.

Thus, there is shown and described a preferred embodiment of the instant invention. The particular configuration shown and described herein relates to an air flow and filtration control system. While this description is directed to a particular embodiment, it is understood that those skilled in the art may conceive modifications and/or variations to the specific embodiments shown and described herein. For example, each fan may be replaced by multiple fans; the specific structure of the headgear skeleton and/or liner may be altered; the types of materials may be varied, or the like. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. An air flow and filtration system comprising:

a headgear structure adapted to be mounted on the head of a wearer, a shroud which is selectively mounted over said headgear structure, a transparent shield mounted to said shroud, fan means mounted at said headgear structure to create a gaseous fluid flow relative thereto, said fan means includes intake fan means and outlet fan means, said intake fan means and said outlet fan means are mounted at different locations on said structure, whereby said gaseous fluid flow passes over the head of a wearer in a uniform manner, filter means included in said shroud and adapted to be located adjacent to said fan means when said shroud is mounted over said headgear structure whereby said gaseous fluid flow created by said fan means is filtered through said filter means.

2. The system recited in claim 1 including, liner straps pivotally mounted to said structure and adapted to snugly engage the head of the wearer.

3. The system recited in claim 1 wherein, said filter means comprises separate and distinct portions of said shroud means.

4. The system recited in claim 3 wherein, said filter means are attached to said shroud means.

5. The system recited in claim 1 wherein, each of said intake fan means and said outlet fan means consists of a single fan.

6. The system recited in claim 1 wherein, said transparent shield is substantially a single plane.

7. The system recited in claim 1 including, channel means in said structure for carrying a fluid therethrough.

8. The system recited in claim 7 wherein, aid channel transmits fluid relative to said fan means.

9. A hood to be worn over a headgear with fan means mounted therein which is used in an air flow and filtration system comprising, a relatively limp flaccid shroud at least portions thereof which operate as filters, said shroud is formed of material which filters to 0.1 micron, and a transparent plate mounted to said shroud to provide a viewing port through said shroud, said plate is defined by a single curvilinear surface.

10. The system recited in claim 1 including connection means for connecting said shroud to said structure.

11. The system recited in claim 1 wherein, said structure includes a rigid frame which substantially surrounds the head of the wearer and includes an upper portion, lower front portion and lower back portion, all of which are joined together.

12. The system recited in claim 11 wherein, said lower front portion and said lower back portion are jointed together by an adjustable pivot joint.

13. The system recited in claim 11 wherein, said lower front portion and said lower back portion are integrally connected with an internal channel extending axially through said lower back portion and said lower front portion.

14. The system recited in claim 1 including, standoff means disposed on said structure adjacent said fan means in order to space said shroud from said fan means.

15. The system recited in claim 1 including, light source means mounted in said structure.

16. The system recited in claim 1 wherein, said structure comprises a high impact plastic material.

17. An open frame headgear structure comprising, an upper support surface, a lower support surface, a temporal support member connected between said upper support surface and said lower support surface, an inner support structure which is adjustable in size, said inner support structure pivotally mounted to said temporal support member, and a plurality of fan means, at least one fan means mounted in said upper support surface, at least one fan means mounted in said lower support surface.

18. The headgear structure recited in claim 17 wherein, said fan means in said upper support surface moves air inwardly relative to said headgear structure and said fan means in said lower support surface moves air outwardly relative to said headgear structure.

19. The structure recited in claim 17 wherein, at least a portion of said lower support surface is pivotally mounted to another portion of said lower support surface.

20. The structure recited in claim 17 including, hood means adapted to cover said structure, said hood means includes a transparent screen mounted thereto and at least a portion thereof which is porous, said portion is arranged to be disposed adjacent to each of said fan means to operate a filter for air flow produced by each of said fan means.

21. The structure recited in claim 17 wherein, at least one of said upper and lower support surfaces includes a hollow conduit which communicates with the associated fan means;

said hollow conduit having an upper and a lower wall.

22. The structure recited in claim 25 wherein, the lower wall of said hollow conduit includes at least one aperture therethrough.

23. The structure recited in claim 21 including, at least one spacer mounted between the upper and lower walls of said hollow conduit.

* * * * *